US006048228A

United States Patent [19]

Aso

[11] Patent Number: 6,048,228

[45] Date of Patent: Apr. 11, 2000

[54] ELECTRICAL CONNECTOR

[75] Inventor: Tatsuaki Aso, Tokyo, Japan

[73] Assignee: Hirose Electric Co., Ltd., Tokyo, Japan

[21] Appl. No.: 09/141,358

[22] Filed: Aug. 27, 1998

[30] Foreign Application Priority Data

Aug. 28, 1997 [JP] Japan ..... 9-245932

[51] Int. Cl.[7] ..... H01R 17/00

[52] U.S. Cl. ..... 439/660; 439/862

[58] Field of Search ..... 439/660, 862

[56] References Cited

U.S. PATENT DOCUMENTS 5,259,769 11/1993 Cruise et al. ..... 439/862

5,326,290 7/1994 Chailleux et al. ..... 439/660

5,904,597 5/1999 Doi et al. ..... 439/660

*Primary Examiner*—Michael L. Gellner

*Assistant Examiner*—Briggitte Hammond

*Attorney, Agent, or Firm*—Kanesaka & Takeuchi

[57] ABSTRACT

A contact element 2 comprises a wiring section 2A, a fixing section 2B, a spring section 2C, a contact section 2D, and a guided section 2E. The contact element is held by the fixing section 2B in a receiving slot 5 of a contact support 3. The contact section 2D is bent so as to project from a window 5A of the contact support 3. The spring section is bent to provide a flexible portion between the fixing and contact sections. The guided section 2E extends obliquely with respect to the plugging direction of the connector for sliding contact with a guiding section 5A1 of the window 5A. The contact and fixing sections 2D and 2B are spaced in the direction perpendicular to the plugging direction.

2 Claims, 3 Drawing Sheets

ELECTRICAL CONNECTOR

BACKGROUND OF THE INVENTION

1. Field of the Invention

The present invention relates to press-contact type electrical connectors and, particularly, to an electrical connector with a contact element not fitted to but merely pressed against a contact element of a mating connector.

2. Description of the Related Art

Japanese patent application Kokai No. 6-20737 discloses such an electrical connector as shown in FIG. 3, wherein a pair of connectors 50 and 60 have a pair of housings 51 and 61 in which contact elements 52 and 62 are arranged in a direction perpendicular to the sheet. The contact sections 52A and 62A of the contact elements are abutted against each other in the plugging direction for making an electrical connection. The contact sections 52A and 62A are made convex and project from the windows 53A and 63A of front covers 53 and 63 so that when the connectors 50 and 60 are plugged in, they are flexed into the interiors of the front covers 53 and 63. That is, the contact sections 52A and 62A are moved inwardly of the front covers 53 and 63 as shown by arrows 54 and 64 of FIG. 3. Thus, the contact elements 52 and 62 are electrically connected with a predetermined pressure.

In the connector of FIG. 3, the contact sections 52A and 62A of contact elements 52 and 62 are bent at the curved portions 55 and 65 and moved only in the horizontal direction shown by the arrows 54 and 64. Consequently, the contact sections 52A and 62A are not vertically rubbed each other. As a result, dust and dirt adheres to the contact sections and causes poor contact.

SUMMARY OF THE INVENTION

Accordingly, it is an object of the invention to provide an electrical connector capable of producing self-cleaning effects, thus providing stable electrical connection.

An electrical connector comprises a contact support with at least one receiving slot having a front opening; at least one contact element received by the receiving slot and having a wiring section at one end and a free end at the other end in the receiving slot and a contact section adjacent to the free end and projecting from the opening so that when the electrical connector is connected to a mating connector, it is brought into contact with a contact section of the mating connector and pushed rearwardly by the mating connector.

According to the invention, the contact element further comprises a fixing section, a spring section, and a guided section in an order from the wiring section to the free end; the fixing section is held in the receiving slot to hold the contact element in place in the receiving slot; the contact section is made convex so as to project from the opening; the spring section is bent to provide a flexible portion between the fixing and contact sections; the guided section extends obliquely with respect to a plugging direction of the electrical connection and is in sliding relationship to a guiding section of the opening; and the contact section is spaced from the fixing section in a direction perpendicular to the plugging direction.

It is preferred that the guiding section of the opening has a guiding surface made along a sliding direction of the guided section of the contact element.

When the electrical connector is plugged into a mating connector, the contact sections of contact elements are spaced from the fixing sections in the vertical direction so that the contact sections are moved both in the horizonal and the vertical directions. The guided sections extend the oblique direction and are moved along the oblique direction. That is, the contact sections are moved both in the horizonal and the vertical directions. The later movement produces the wiping effect.

DESCRIPTION OF THE PREFERRED EMBODIMENT

Embodiments of the invention will be described with reference to the accompanying drawings.

Figure 1:
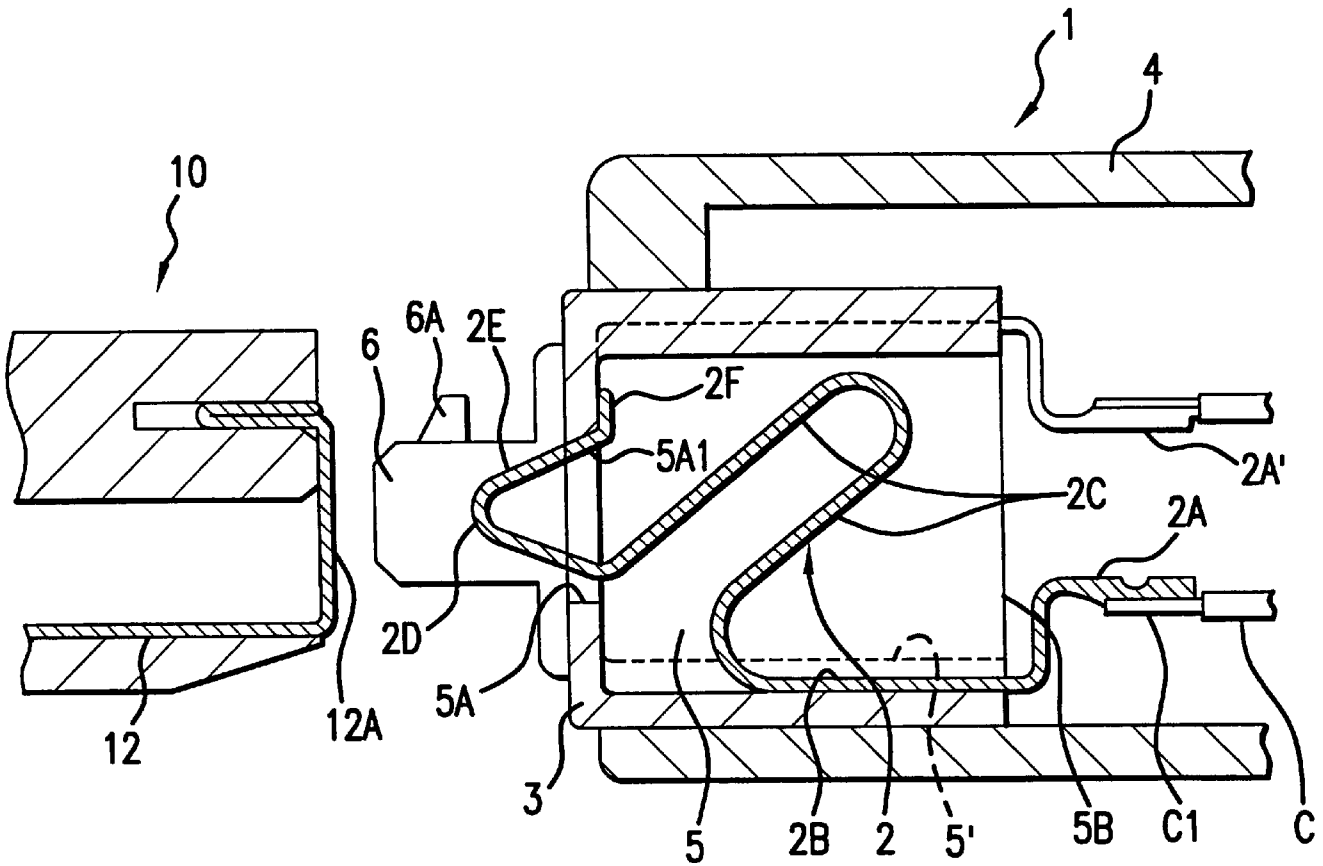
FIG. 1 is a sectional view of an electrical connector according to an embodiment of the invention before connection to a mating connector.

In FIG. 1, an electrical connector 1 comprises a housing 4, a contact support 3, and a contact element 2 supported in the contact support 3.

The contact support 3 is made from an insulative material so as to have a substantially cubit form. A plurality of receiving slits 5 are provided in the contact support 3 at regular intervals in the direction perpendicular to the sheet. Each receiving slit 5 has a front window 5A, a rear opening 5B, and a substantially square space between them.

Each contact element 2 is made by bending a metal strip so as to provide a wiring section 2A, a fixing section 2B, a spring section 2C, a contact section 2D, a guided section 2E, and an engaging section 2F.

An engaging claw (not shown) is provided on the fixing section 2B of a contact element 2 to hold the contact element 2 in place in the receiving slot 5.

The rear portion of the contact element extends rearwardly from the contact support 3 and bent in an S-shape to form the wiring section 2A to which a core wire C1 of a cable C is soldered.

The spring section 2C extends forwardly from the fixing section 2B in a U-shaped form.

The contact section 2D extends forwardly from the spring section 2C in a C-shaped form which projects from the window 5A of the contact support 3. The guided section 2E extends obliquely from the contact section 2D toward the free end. The free end is bent to form the engaging section 2F for contact with the inside wall of the contact support 3 and functions as a stopper. The guided section 2E is abutted against a guiding section 5A1 of the window 5A. It is preferred that the guiding section 5A1 has a sloping face extending along the guided section 2E.

The contact elements 2 are arranged alternately upside down in the receiving slots 5 as shown in FIG. 1. A reversed receiving slot 5' and wiring section 2A' are shown by a phantom line and a solid line, respectively.

A fitting section 6 and a locking hook 6A are provided on each side of the housing 4 for connection with a mating connector.

A mating connector 10 comprises a housing 11 and a contact element 2 attached to the housing at a position corresponding to the contact element 2. The contact element 11 has a contact section 12A on the front face of the housing 11.

The electrical connector 1 is connected to the mating connector 10 as follows.

Figure 2:
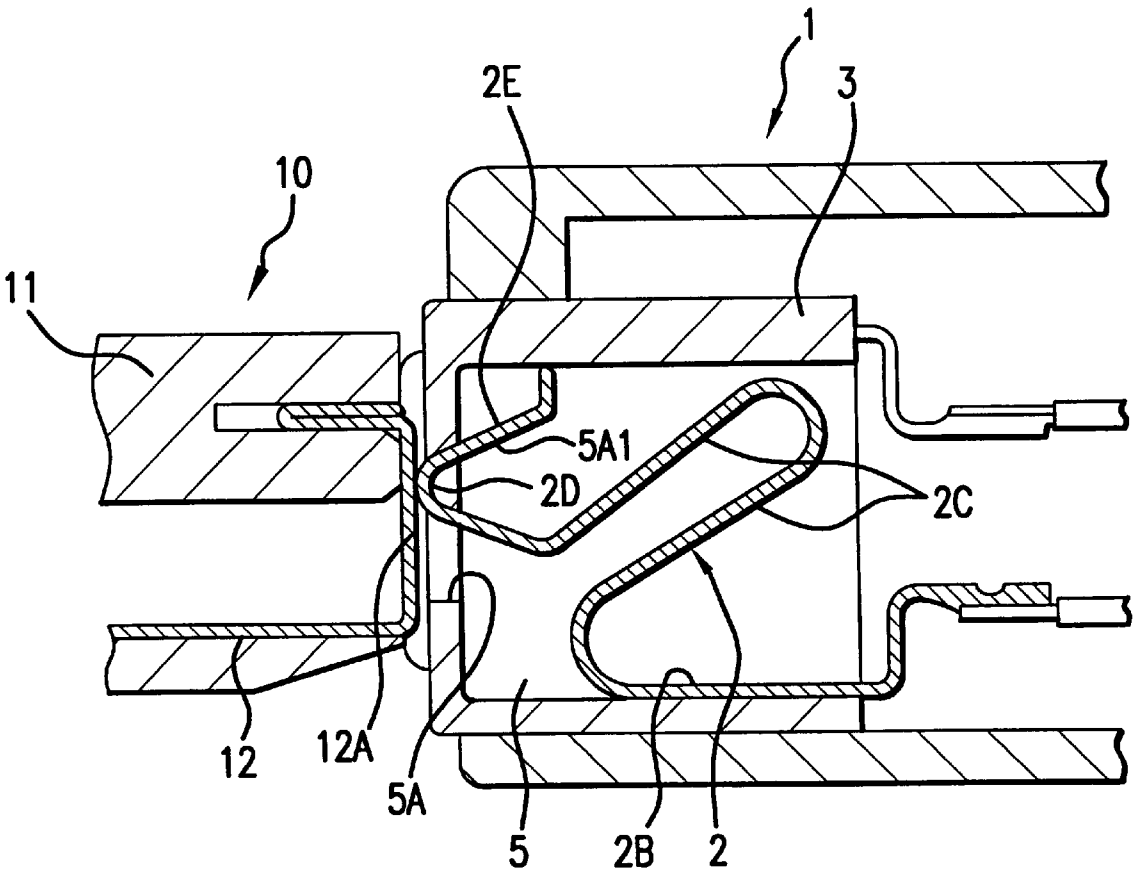
FIG. 2 is a sectional view of the electrical connector in connection with the mating connector.
Figure 3:
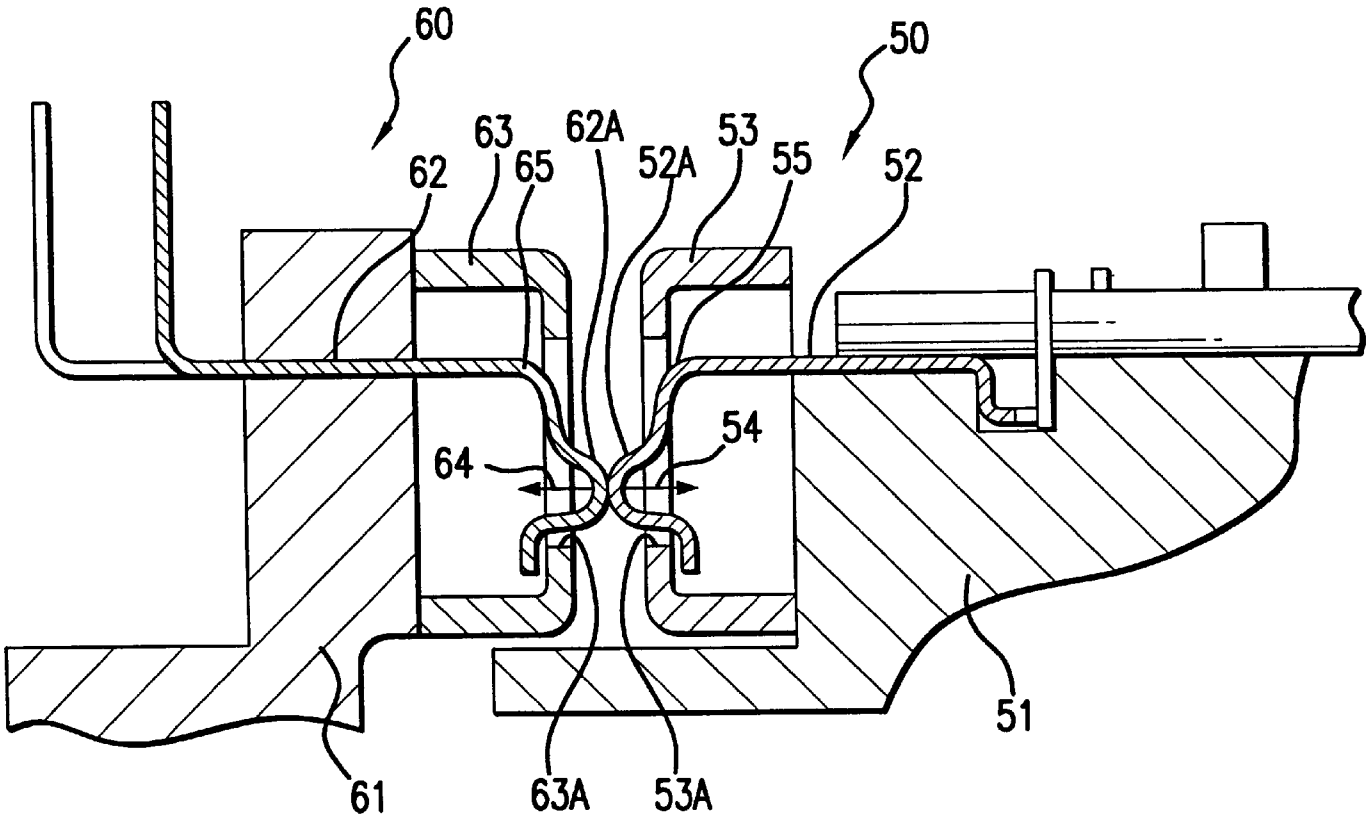
FIG.3 (PRIOR ART)
FIG. 3 is a sectional view of a conventional electrical connector.

In FIG. 2, the connector 1 is guided by the fitting sections 6 for connection to the mating connector 10 and locked by the locking hooks 6A in place.

As the connector 1 is moved to the above locking position, the contact section 2D of the contact element 2 is pressed against the contact section 12A of the contact element 12 and moved back into the receiving slot 5. This movement is made possible by the elastic deformation of the spring section 2C.

Since the guided section 2E slides on the oblique guiding section 5A1 of the window 5A, the contact section 2D moves in the same oblique direction. That is, the contact section 2D moves both in the first direction in which it moves into the interior of the receiving slot 5 and in the second direction (upward direction) which is perpendicular to the first direction. The latter movement makes friction with the contact section 12A of the contact element 12. Consequently, the contact sections 2D and 12A are rubbed each other to wipe out dust and dirt from the contact sections, thus providing a stable electrical connection.

The shape of the spring section may be modified, as far as there is a space between the contact section and the fixing section 2B in the vertical direction to allow the vertical (upward) movement of the contact section, thus providing the wiping effect.

As has been described above, the contact section is moved in the vertical (upward) direction as well as in the horizonal direction (plugging direction) so that the wiping effect is produced to clean the contact sections, assuring a stable electrical connection. The contact elements have a simple shape so that it is easy to manufacture.

What is claimed is:

1. An electrical connector comprising:

a contact support with at least one receiving slot having a front opening, said front opening being provided with a guiding section;

at least one contact element provided in said receiving slot and having a wiring section at one end and a free end at the other end in said receiving slot and a contact section adjacent to said free end and projecting from said opening so that when said electrical connector is plugged into a mating connector, it is brought into contact with a contact section of said mating connector and pushed rewardly by said mating connector, characterized in that said contact element further comprises a fixing section, a spring section, and a guided section arranged from said wiring section to said free end;

said fixing section is held in said receiving slot to hold said contact element in place in said receiving slot;

said contact section is made convex so as to project from said front opening;

said spring section is bent to provide a flexible portion between said fixing and contact sections;

said guided section extends obliquely with respect to a plugging direction of said electrical connector and is placed in contact with said guiding section; wherein when said electrical connector is plugged into said mating connector, said guided section slides on said guiding section in the oblique direction with respect to the plugging direction so that said contact section moves in the same oblique direction; and said contact section is spaced from said fixing section in a direction perpendicular to said plugging direction.

2. An electrical connector according to claim 1, wherein said guiding section of said front opening has a guiding surface made along a sliding direction of said guided section of said contact element.

* * * * *